US005096214A

United States Patent [19]

Walker et al.

[11] Patent Number: 5,096,214

[45] Date of Patent: Mar. 17, 1992

[54] PORTABLE ENCLOSURE

[76] Inventors: Lionel Walker, 1819 Alabama St.; Horace D. Tilley, Rt. 6 Box 1845, both of Ruston, La. 71270

[21] Appl. No.: 506,223

[22] Filed: Apr. 9, 1990

[51] Int. Cl.[5] ..... B62B 1/00

[52] U.S. Cl. ..... 280/47.26; 135/93; 135/101; 135/115; 135/901

[58] Field of Search ..... 135/900-902, 135/DIG. 8, 93, 117, 119, 120, 101, 114, 115; 280/47.26, 47.24

[56] References Cited

U.S. PATENT DOCUMENTS

| | | | |
|---|---|---|---|
| 659,114 | 10/1900 | Voorhies . | |
| 1,128,558 | 2/1915 | Voorhies . | |
| 1,377,788 | 5/1921 | Pennewell | 135/117 |
| 2,010,472 | 8/1935 | Angel . | |
| 2,022,211 | 11/1935 | Leffert . | |
| 2,928,404 | 3/1960 | Klages . | |
| 3,034,523 | 5/1962 | Deshano . | |
| 3,218,090 | 11/1965 | Herman | 280/47.26 |
| 3,241,750 | 3/1966 | Brighton | 280/47.26 X |
| 3,581,751 | 6/1971 | Evans . | |
| 3,739,536 | 6/1973 | Ward | 135/117 X |
| 3,865,429 | 2/1975 | Barker . | |
| 3,880,459 | 4/1975 | Kelley | 135/117 X |
| 3,971,395 | 7/1976 | Lipinski | 135/117 X |
| 4,926,893 | 5/1990 | Klopfenstein et al. | 135/901 X |

*Primary Examiner*—David A. Scherbel
*Assistant Examiner*—Lan Mai
*Attorney, Agent, or Firm*—John M. Harrison

[57] ABSTRACT

A portable enclosure which is suitable for use as a portable bus stop or the like and includes a frame constructed of plastic pipe, a canopy covering the top and bottom portions of the frame and a clear plastic window area located in the center section of the frame between the canopy segments, for viewing purposes. The portable enclosure is fitted with a pair of wheels and a handle positioned above the wheels for transportation purposes and includes a door for ingress and egress and a seat for accommodating the occupant or occupants.

8 Claims, 2 Drawing Sheets

PORTABLE ENCLOSURE

BACKGROUND OF THE INVENTION

1. Field of the Invention

This invention relates to enclosures and more particularly, to a portable enclosure which may be quickly and easily transported from one location to another, in order to accommodate and shelter people for various purposes. A typical function of the portable enclosure is to provide a temporary structure for sheltering children while the children wait for transportation on school days. Another use is a temporary shelter for the homeless. In a preferred embodiment the portable enclosure is fitted with a pair of wheels and a handle positioned above the wheels for transportation purposes and further includes a cover having a top cover segment which extends downwardly from the enclosure top, a side cover segment spaced from the top cover segment and a clear plastic window located between the top cover segment and the bottom cover segment. In a preferred embodiment the plastic window and cover segments are installed on the portable enclosure and connected by means of snaps to facilitate replacement and removal of the clear plastic window during good weather.

Stationary enclosures have long been utilized in public transportation systems at outside locations to shelter customers while the customers are waiting. These structures are typically constructed of aluminum and glass or "Plexiglass", with a bench located inside for seating purposes. However, there have typically been no similar provisions made for circumstances where children are waiting for bus or other transportation to school. Accordingly, the children usually congregate at designated bus stop locations in urban and suburban neighborhoods and are many times exposed to inclement weather for at least a brief period of time before the bus or other transportation arrives. Furthermore, the ever-increasing number of America's homeless are forced to subsist in the cities in whatever structures are available, including abandoned buildings, cardboard boxes and like shelter, which are, at best, poorly designed for the purpose. Accordingly, there is a need for a temporary enclosure or shelter which is portable, durable and inexpensive for these and other sheltering purposes.

2. Description of the Prior Art

Various temporary shelters and shading devices are known in the art. An early "Cotton Picker's Shade" is detailed in U.S. Pat. No. 659,114, dated Oct. 2, 1900, to A. Voorhies. The device includes with four wheels and a rope support extending around the frame for supporting a tarpaulin and creating shade for people picking cotton. A "Portable Canopy" is detailed in U.S. Pat. No. 1,128,558, dated Feb. 16, 1915, also to A. Voorhies. The canopy includes a pipe frame, a pair of large wheels rotatably mounted on the center section of the frame and a pair of small wheels mounted on the forward section of the frame, along with a tiltable canopy located at the top of the frame for creating shade. A "Beach Accessory" is detailed in U.S. Pat. No. 2,010,472, dated Aug. 6, 1935, to H. E. Angel. The beach accessory is characterized by an inflatable air mattress designed for use with a cabana-type structure which may be rolled in stored configuration and functionally deployed to shield an occupant or occupants from the elements. A "Portable Lawn Canopy" is detailed in U.S. Pat. No. 2,022,211, dated Nov. 26, 1935, to C. B. Leffert. The lawn canopy includes a curved top portion and screen side portions mounted on a frame, which frame is provided with four wheels for transportation purposes. U.S. Pat. No. 2,928,404, dated Mar. 15, 1960, to J. W. Klages, details a "Collapsible Shelter" which is characterized by a hexagonally-shaped top and corresponding side portions mounted on a rigid frame. A window is provided in at least one of the side portions and the side portions are attached to the frame by means of snaps or other fasteners to facilitate selective removal. U.S. Pat. No. 3,034,523, dated May 15, 1962, to R. J. Deshano, details a "Collapsible Tent Shelter". The tent shelter includes a metal frame fitted with a flexible seat and a flexible cover material is attached to the three sides and the top of the frame, with one side of the tent shelter open for access by an occupant or occupants. The collapsible tent shelter is foldable into a portable package when not in use. A "Collapsible and Portable Shelter" is detailed in U.S. Pat. No. 3,581,751, dated June 1, 1971, to Bertrand E. Evans. The collapsible and portable shelter includes a frame structure having inverted L-shaped members, with a radially-extending portion pivotally connected to a support unit at the lower rear part of the back of the shelter. A cover is attached to the frame members and the frame members pivot at the support unit for folding and unfolding the shelter. A fixture is secured to the unit for supporting the shelter in unfolded configuration. U.S. Pat. No. 3,865,429, dated Feb. 11, 1975, to Joseph K. Barker, details a "Portable Collapsible Shelter". The body of the shelter is formed by multiple identical panels, two of which form the end walls and the other two of which shape the back wall. The back wall panels are hinged together by flexible strips and are similarly hinged to the back edges of the side walls. Flexible sheets form the top and bottom of the shelter and allow for hinging of the two back wall panels relative to each other and hinging of the end wall panels relative to the back wall, such that the body of the structure can be folded flat when not in use. A visor shields the top of the open front and a novel apron covers the lower part of the front and extends over the knees of an occupant or occupants of the shelter, the height of the upper edge of the apron being adjustable.

It is an object of this invention to provide a new and improved portable enclosure which is characterized by a substantially rigid frame, a top cover provided on the frame and extending around the top, side and end edges of the frame, a bottom cover extended around the bottom side and end portions of the frame and a clear plastic window provided between the top and bottom cover portions for viewing purposes.

Another object of the invention is to provide a portable enclosure which is fitted with a pair of spaced wheels and a handle located above the wheels for transportation purposes.

Still another object of this invention is to provide a portable enclosure and shelter which is designed for use as a portable bus stop, a shelter for the homeless and like structure, which portable enclosure is characterized by a substantially rigid polyvinyl chloride (pvc) frame, a pair of spaced wheels attached to the frame, along with a handle located above the wheels for transporting the structure, and a removable cover mounted on the frame for sheltering the occupants.

A still further object of this invention is to provide a portable enclosure or shelter which is suitable for use as a portable bus stop and other temporary shelter and is characterized in a preferred embodiment by a substantially rigid plastic pipe frame, a top cover provided on the frame, a bottom cover extending around the front. rear and sides of the frame near the bottom of the frame and a clear plastic window provided between the top cover and the bottom cover and further including a door and seat mounted in the frame for accessing the interior of the portable enclosure by the occupants and seating the occupants, respectively.

Yet another object of this invention is to provide a light-weight, portable, vented enclosure which is designed to serve as a portable bus stop, a shelter for the homeless or like sheltering structure, which portable enclosure includes, in a preferred embodiment, a frame constructed of polyvinyl chloride (pvc) plastic pipe, a cover attached to the frame, which cover extends over the top and around the upper portions of the side, front and rear panels of the frame, a bottom cover extending around the bottom portions of the sides, front and rear frame panels, a clear, plastic viewing area attached to the top cover and bottom cover, respectively, a seat located inside the frame for seating the occupants and a door hingedly attached to the frame for accessing the interior of the portable enclosure and further including a pair of wheels rotatably attached to the enclosure frame and a handle located above the wheels for transporting the enclosure to selected locations.

SUMMARY OF THE INVENTION

These and other objects of the invention are provided in a new and improved portable enclosure for sheltering children and adults, which portable enclosure includes in a most preferred embodiment, a frame constructed of pvc pipe and fittings, a seat provided in the frame for seating the occupants, a door hingedly attached to the frame for accessing the interior of the portable enclosure, a first cover portion extending across the top and around the upper side and end portions of the frame, a second cover portion extending around the sides and ends of the bottom portion of the frame. a clear plastic viewing panel attached to the top and bottom cover portions, respectively, with snaps or other fasteners, for selectively removing the clear plastic viewing panel, and a pair of wheels and a handle located above the wheels, both rigidly attached to the frame in spaced relationship for transporting the portable enclosure from one location to another.

BRIEF DESCRIPTION OF THE DRAWING

The invention will be better understood by reference to the accompanying drawings, wherein.

DESCRIPTION OF THE PREFERRED EMBODIMENTS

Figure 1:
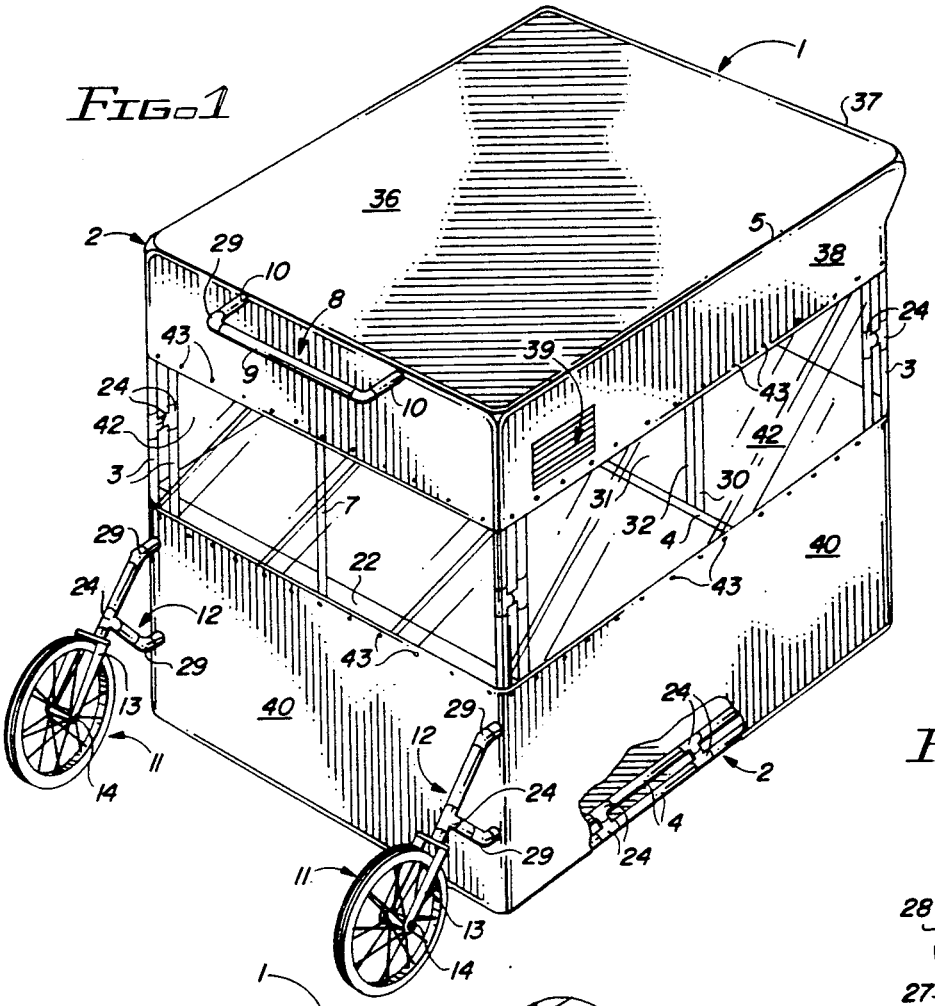
FIG. 1 is a rear perspective view, partially in section, of the top, rear and left side portions of a preferred embodiment of the portable enclosure of this invention.
Figure 5:
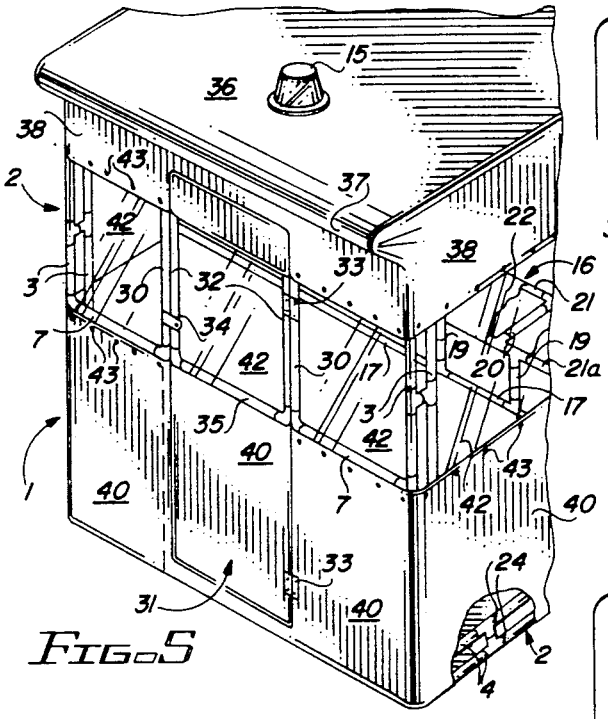
FIG. 5 is a front perspective view, partially in section, of the top, front and right side portions of the portable enclosure illustrated in FIG. 1.

Referring initially to FIGS. 1 and 5 of the drawings, the portable enclosure of this invention is generally illustrated by reference numeral 1. The portable enclosure 1 includes a substantially rigid enclosure frame 2, constructed of parallel sets of vertical frame members 3 and base frame members 4, along with top frame members 5. In a preferred embodiment of the invention a cover overhang 37 is provided in the top of the portable enclosure 1, in order to at least partially shield the occupants of the portable enclosure 1 during ingress and egress. A pair of wheels 11 are each rotatably mounted on a separate axle 14, which extends through a corresponding fork 13, carried by a wheel frame 12, which wheel frame 12 is, in turn, attached to the rear of the enclosure frame 2 in spaced relationship, as illustrated in FIG. 1. A handle 8 projects from the rear portion of the enclosure frame 2 above the wheels 11 and further includes a handle bar 9, secured to the top frame members 5 by means of parallel bar mounts 10, as further illustrated in FIG. 1. Middle frame members 7 serve to stiffen the enclosure frame 2 as still further illustrated in FIG. 1.

Figure 3:
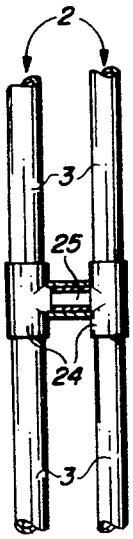
FIG. 3 is a sectional view of a pair of vertical frame members incorporated in the enclosure frame of the portable enclosure illustrated in FIGS. 1 and 2, more particularly illustrating a first preferred means for connecting the vertical, parallel frame members together.
Figure 4:
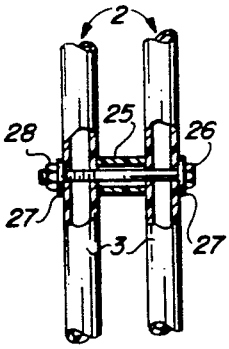
FIG. 4 is a sectional view of a pair of vertical frame members incorporated in the enclosure frame of the portable enclosure illustrated in FIGS. 1 and 2, more particularly illustrating a second preferred means for connecting the vertical, parallel frame members together.

Referring now to FIGS. 1, 3 and 4 of the drawings, in a first preferred embodiment of the invention the two spaced sets of parallel vertical frame members 3 are located in the plane of the side members of the enclosure frame 2, respectively, and are secured to each other by means of a pair of facing T-fittings 24, each having a nipple 25 inserted in the bottom legs or runs thereof, respectively, and glued in place, as illustrated in FIG. 3. Alternatively, the respective sets of vertical frame members 3 can be connected to each other by means of a nipple 25, disposed between the vertical frame members, a bolt 26 which extends through registering openings (not illustrated) drilled in the vertical frame members 3 and through the nipple 25, a pair of washers 27, seated at both ends of the bolt 26 against the vertical frame members 3, respectively, and a nut 28 threaded on the end of the bolt 26, as further illustrated in FIG. 4.

Figure 6:
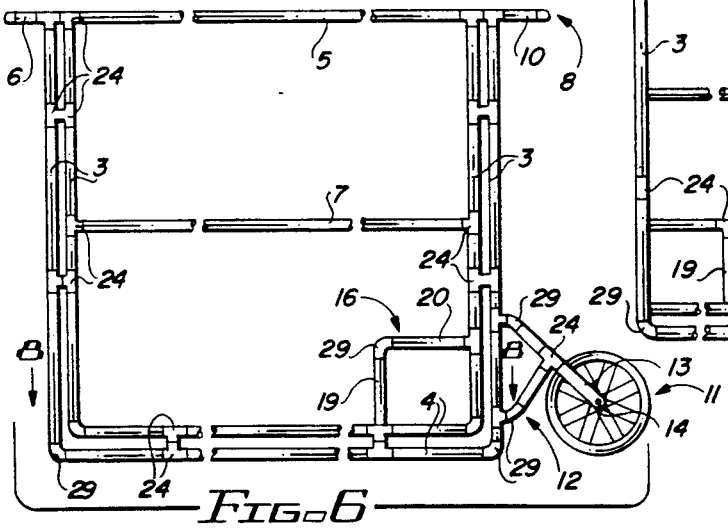
FIG. 6 is a right side view of the right side portion of the enclosure frame of the portable enclosure illustrated in FIG. 1.

Referring now to FIGS. 3–9, it will be appreciated that the parallel base frame members 4 of the enclosure frame 2 may also be joined by means of the T-fittings 24, as illustrated in FIG. 3 or alternatively by using bolts 26, as illustrated in FIG. 4. In another most preferred embodiment of the invention each wheel frame 12 with wheels 11 is attached to the outer one of a rear set of the vertical frame members 3 using T-fittings 24, as well as 45° elbow fittings 29, as illustrated in FIG. 6. It will be further appreciated from a consideration of the right side, front and rear portions of the enclosure frame 2 of the portable enclosure 1 illustrated in FIGS. 6, 7 and 9, respectively, that the top frame members 5 are joined to the respective sets of vertical frame members 3 by means of the T-fittings 24. Similarly, the parallel sets of base frame members 4 are joined to the parallel vertical frame members 3, respectively, by means of elbow fittings 29 and the middle frame members 7 are attached to the top frame members 5, as well as the inside ones of the vertical frame members 3 and the base frame members 4, by means of T-fittings 24 and a four-way fitting 23, as further illustrated in FIGS. 6 and 9. Accordingly, it will be appreciated from a consideration of FIGS. 6-9 that the wall and base perimeter of the parallel side portions, as well as the bottom of the rear end of the enclosure frame 2, are constructed of an outer frame and an inner frame, the respective sets of vertical frame member 3 and base frame member 4 components of which are joined, respectively, by T-fittings 24, as illustrated in FIG. 3, or alternatively, by using bolts 26, as illustrated in FIG. 4. It has been found that this double-component construction results in an enclosure frame 2 which is unusually rigid and strong and yet non-corrosive and light in weight, a construction which is ideal for the intended purpose.

Figure 7:
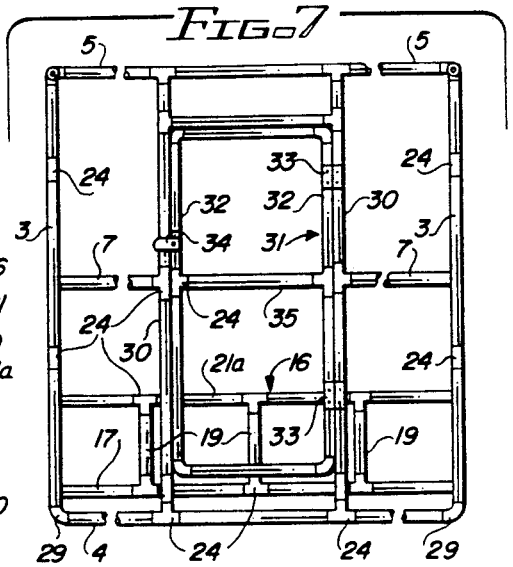
FIG. 7 is a front view of the front portion of the enclosure frame of the portable enclosure illustrated in FIG. 1.
Figure 9:
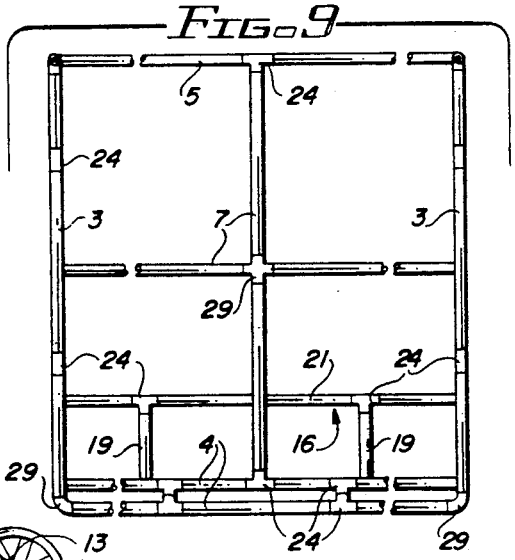
FIG. 9 is a rear view of the rear portion of the enclosure frame illustrated in FIG. 1.
Figure 8:
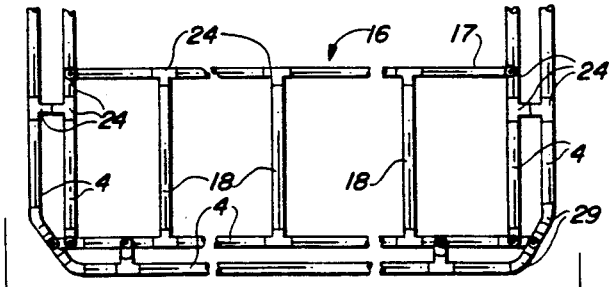
FIG. 8 is a sectional view of the bottom frame segment of the portable enclosure, taken along 8—8 of the right side portion of the enclosure frame illustrated in FIG. 6.

Referring now to FIGS. 5-9, in a most preferred embodiment of the invention a base seat frame 16 is provided inside the portable enclosure 1 and is mounted to the inside ones of the rear spaced sets of the vertical frame members 3 and the base frame members 4, respectively. The base seat frame 16 is characterized by a bottom cross-member 17, which extends between the parallel inside ones of the base frame members 4 located in the sides of the enclosure frame 2, and is attached at each end to these inner base frame members 4 by means of a T-fitting 24, as illustrated in FIG. 8. Multiple bottom struts 18 extend in parallel, spaced relationship from the bottom cross-member 17 to a corresponding inner one of the base frame members 4 which spans the rear of the enclosure frame 2, as further illustrated in FIG. 8. In a most preferred embodiment of the invention these bottom struts 18 are disposed in equally spaced relationship between the bottom cross-member 17 and the base frame member 4 and are attached thereto by means of additional T-fittings 24. Furthermore, a rear top cross member 21 extends parallel to and above the bottom cross member 17, as illustrated in FIG. 5, and is anchored to opposite ones of the vertical frame members 3 by means of a pair of T-fittings 24. Moreover, top struts 20 extend in spaced, parallel relationship from the rear top cross-member 21 to a corresponding front top cross-member **21*a*, which is supported by vertical seat suppports 19, as illustrated in FIGS. 6, 7 and 9. In a most preferred embodiment of the invention the top struts 20 are secured to the rear top cross member 21 and the respective front top cross-member 21*a* by means of additional T-fittings 24 and elbow fittings 29, as further illustrated in FIG. 5. Similarly, the vertical seat supports 19 are secured to the front top cross-member 21*a* and the bottom cross-member 17 by means of additional T-fittings 24 and a pair of elbow fittings 29, disposed on the end ones of the vertical seat supports 19, as illustrated in FIG. 6. A flexible seat cover 22 is stretched over the rear top cross-member 21, the front top cross-member 21*a* and the corresponding top struts 20, as further illustrated in FIGS. 1 and 5**.

Referring again to FIGS. 5 and 7 of the drawings, in a most preferred embodiment of the invention a door 31 is provided in the front portion of the enclosure frame 2 and is characterized by rectangular-shaped door frame 32. The door frame 32 is fitted with a horizontal center frame member 35 and is attached to parallel door frame supports 30 by means of spaced hinges 33. A door latch 34 is provided on the opposite side of the door frame 32 for securing the door in closed configuration in the same plane as the door frame supports 30.

Referring again to FIGS. 1, 5 and 6 of the drawings, a top cover 36 is stretched over the top or roof portion of the enclosure frame 2 and is provided with a cover overhang 37 which extends around the overhang 6 provided in the top frame members 5, illustrated in FIG. 6. The cover overhang 37 may also be tilted slightly upwardly, as desired, to facilitate a flow of rainwater from the cover overhang 37 across the top cover 36 and from the portable enclosure 1. A top cover extension 38 extends from the top cover 36 around the periphery of the top frame members 5 and downwardly, skirting the top portions of the vertical frame members 3, as further illustrated in FIGS. 1 and 5. In a most preferred embodiment of the invention the bottom edges of the top cover extension 38 are fitted with female snap elements 43, for mounting a clear plastic sheet 42 in the center section of the enclosure frame 2, stretched around the outside ones of the vertical frame members 3, with a plastic panel provided in the door 31, as further illustrated in FIGS. 1 and 5. Accordingly, it will be appreciated that the top edge of the clear plastic sheet 42 is provided with corresponding male snap elements (not illustrated) for engaging the female snap elements 43 located on the top cover extension 38 and removably securing the clear plastic sheet 42 in position. A side cover 40 is also stretched around the outside ones of the vertical frame members 3, with a cover panel provided in the door 31, and extends from the base frame members 4 upwardly to the bottom edge of the clear plastic sheet 42. Accordingly, in a most preferred embodiment of the invention the bottom edge of the clear plastic sheet 42 is also provided with male snap elements (not illustrated), which engage additional female snap elements 43 provided in the upper edges of the side cover 40, for removably mounting the clear plastic sheet 42 between the top cover extension 38 and the side cover 40 and allowing clear visibility of the occupant from the interior of the portable enclosure 1. In another most preferred embodiment of the invention a vent 39 is provided in the right and left side portions of the top cover extension 38 for ventilation purposes, as illustrated in FIG. 1.

Figure 2:
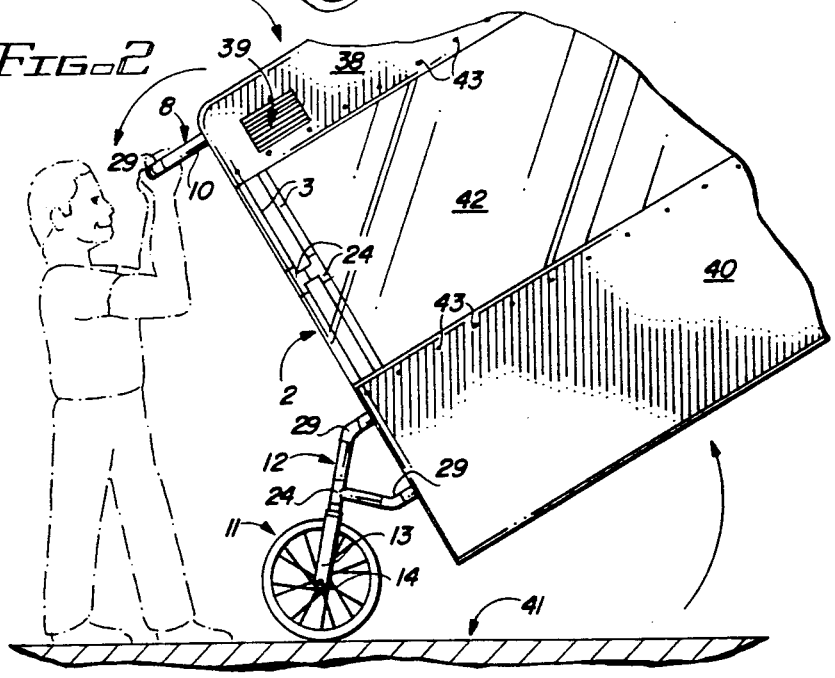
FIG. 2 is a left side view, partially in section, of the portable enclosure illustrated in FIG. 1, in transportation configuration.

Referring again to FIGS. 1 and 2 of the drawings, it will be appreciated by those skilled in the art that the portable enclosure 1 is sufficiently light to facilitate transportation to and from several locations in the manner illustrated in FIG. 2. This transportation is effected by initially grasping the handle 8, tilting the portable enclosure 1 in the direction of the arrow as illustrated in FIG. 2 and pulling or pushing the portable enclosure 1 along the street or sidewalk 41. The portable enclosure 1 is easily transported in this manner, since the enclosure frame 2 is constructed of polyvinyl chloride (pvc) pipe and the T-fittings 24 and elbow fittings 29 are also constructed of pvc material, which is light in weight. Furthermore, the top cover 36, top cover extension 38 and side cover 40 are most preferably constructed of light-weight, rip-stop nylon or an equivalent light-weight, strong and durable waterproof material, whereas the clear plastic sheet 42 may be constructed of "Plexiglass" or other semi-flexible or flexible, transparent plastic material known to those skilled in the art having sufficient structural integrity and transparency for the purpose. It will be appreciated that the top cover 36, along with the cover overhang 37, the side cover 40 and the clear plastic sheet 42 may be easily removed and replaced by operation of the snaps. Alternatively, other fasteners known to those skilled in the art may be used in place of the snaps, as desired, according to the knowledge of those skilled in the art.

Referring again to FIGS. 1, 2 and 6 of the drawings, it will be appreciated that the wheel frame 12 element of the wheels 11 is secured to the upward-standing outside ones of the parallel vertical frame members 3 such that the wheels 11 are normally spaced from the supporting surface, such as the street or sidewalk 41, upon which the outside ones of the base frame members 4 rest when the portable enclosure 1 is disposed in the normal functional configuration illustrated in FIG. 1. Accordingly, it will be appreciated that the wheels 11 only touch the street or sidewalk 41 or other supporting surface when the handle 8 is grasped by a user as illustrated in FIG. 2 and the portable enclosure 1 is tilted upwardly in the direction of the arrow to engage the wheels 11 with the street or sidewalk 41 in rolling configuration.

Referring again to FIG. 5 of the drawing in a most preferred embodiment of the invention a blinking light 15 is mounted on the top of the portable enclosure 1 to alert a bus driver as to occupancy of the portable enclosure 1. The light 15 also serves to improve visibility of the portable enclosure 1 in bad weather.

It will be further appreciated by those skilled in the art that the enclosure frame 2 of the portable enclosure 1 is assembled using the vertical frame members 3, base frame members 4, top frame members 5 and middle frame members 7 and assembling these frame members by operation of the T-fittings 24 and elbow fittings 29, as well as the four-way fitting 23, using a suitable glue which is well known to those skilled in the art. Alternatively, it will be appreciated that other structural elements, including aluminum and the like, can be utilized as desired, although pvc pipe is preferred because of its lightness in weight and ease of construction.

Accordingly, while the preferred embodiments of the invention have been described above, it will be recognized and understood that various modifications may be made therein and the appended claims are intended to cover all such modifications which may fall within the spirit and scope of the invention.

Having described our invention with the particularity set forth above, what is claimed is:

1. A portable enclosure for sheltering at least one occupant from the weather, comprising a frame constructed of plastic pipe and pipe fittings and having vertical front frame members characterized by spaced, parallel sets of front frame plastic pipe members, each of said sets spaced by a first set of spacers; horizontal side frame members connected to said front frame members; vertical rear frame members characterized by spaced, parallel sets of rear frame plastic pipe members, each of said sets spaced by a second set of spacers connected to said horizontal side frame members; horizontal top frame members connected to said vertical front frame members and said vertical rear frame members, respectively; and horizontal bottom frame members characterized by spaced, parallel front frame plastic pipe members, each of said sets spaced by a third set of spacers connected to said vertical front frame members and said vertical rear frame members, respectively; a door hingedly mounted on said front frame members; a top cover portion covering the top of said top frame members; a top cover extension extending downwardly from said top cover portion around the top segments of said front frame members, said side frame members and said rear said front frame members, said side frame members and said rear frame members, said side cover portion spaced from said top cover extension; a pair of wheels carried by said rear frame members; and a handle carried by said rear frame members above said wheels, whereby said portable enclosure may be transported on said wheels responsive to grasping said handle and tilting said portable enclosure and said wheels into rolling configuration.

2. The portable enclosure of claim 1 further comprising a flexible, transparent sheeting provided on said front frame members, said side frame members and said rear frame members between said top cover extension and said side cover portion.

3. The portable enclosure of claim 1 further comprising seat means carried by said rear frame members for seating the occupants of said portable enclosure.

4. The portable enclosure of claim 1 further comprising:

(a) a flexible transparent sheeting provided on said front frame members, said side frame members and said rear frame members between said top cover extension and said side cover portion; and (b) seat means carried by said rear frame members for seating the occupants of said portable enclosure.

5. The portable enclosure of claim 1 further comprising a door hingedly mounted in said front frame members for accessing the interior of said portable enclosure.

6. The portable enclosure of claim 1 further comprising:

(a) a flexible, transparent sheeting provided on said front frame members, said side frame members and said rear frame members between said top cover extension and said side cover portion;

(b) seat means carried by said rear frame members for seating the occupants of said portable enclosure; and (c) a door hingedly mounted in said front frame members for accessing the interior of said portable enclosure.

7. The portable enclosure of claim 1 further comprising fastening means provided on said top cover portion, said side cover portion and said sheeting for removably securing said sheeting to said top cover portion and said side cover portion.

8. The portable enclosure of claim 7 wherein said fastening means further comprises snaps.

* * * * *